United States Patent [19]

Sanders et al.

[11] 4,000,817

[45] Jan. 4, 1977

[54] THREE LEVEL STACKING CONTAINER

[75] Inventors: Ellsworth E. Sanders, Sanibel Island, Fla.; Elsmer W. Kreeger, Pontiac, Mich.

[73] Assignee: Pinckney Molded Plastics, Inc., Pinckney, Mich.

[22] Filed: May 8, 1974

[21] Appl. No.: 467,851

[52] U.S. Cl. ..... 206/505; 206/507; 211/126

[51] Int. Cl.[2] ..... B65D 21/04; A47F 1/14

[58] Field of Search ..... 206/505, 507; 211/126

[56] References Cited

UNITED STATES PATENTS

| | | | |
|---|---|---|---|
| 3,398,840 | 8/1968 | Wilson | 206/505 |
| 3,403,788 | 10/1968 | Kreeger | 206/507 |
| 3,404,804 | 10/1968 | Frater | 206/505 |
| 3,825,114 | 7/1974 | Johnson | 206/507 |

*Primary Examiner*—George E. Lowrance
*Attorney, Agent, or Firm*—Whittemore, Hulbert & Belknap

[57] ABSTRACT

An open top container adapted to stack with another container of identical construction at any one of three different levels. The container has stacking feet near the bottom. It also has saddles at three different levels for supporting the feet of an upper container. The container in its preferred form also has guiding means to permit it to be slid over the top of a lower container into a stacked position either at the upper level or at an intermediate level.

20 Claims, 20 Drawing Figures

THREE LEVEL STACKING CONTAINER

SUMMARY OF THE INVENTION

One of the main purposes of this invention is to provide a container which will stack with another identical container at any one of at least three different levels. The container is designed particularly for the bakery industry but obviously may be used to carry many different products. When used in the bakery industry the containers might carry donuts or rolls for example when stacked at the lowermost level, cakes or some other slightly higher product when stacked at the second or intermediate level and bread when stacked at the upper level. The stacking means solidly supports a stack of containers so that the containers will not be crushed. The empty containers when returned to the factory take up only a minimum amount of space when stacked at the lowermost level.

As a further feature of the invention, guide means are provided to enable an upper container to be slid over a lower container into stacked relation therewith at either the upper or the intermediate level. One or more walls of the container are preferably cut out or recessed to provide ready access to the contents even when the containers are stacked.

In the specific embodiments of the invention about to be described, the containers will stack either at the upper or intermediate level when turned end for end relative to one another. The containers will stack at the lowermost level when they are similarly oriented.

Figure 12:
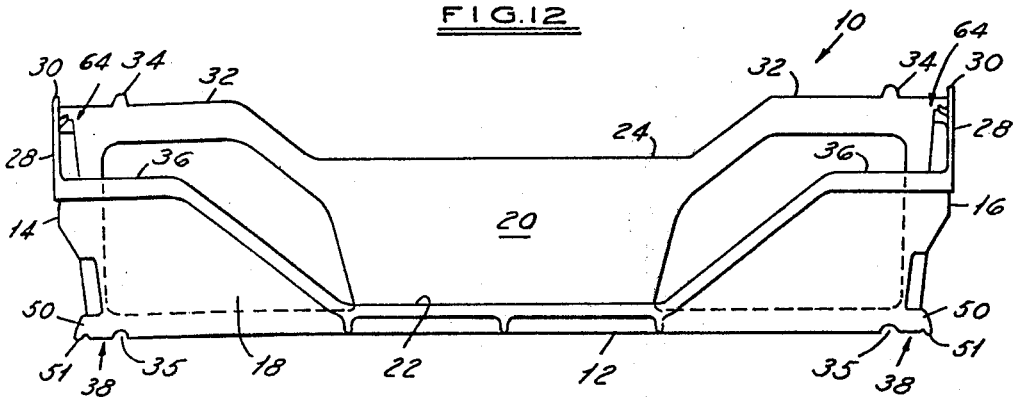
FIG. 12 is a front view of the container.
Figure 13:
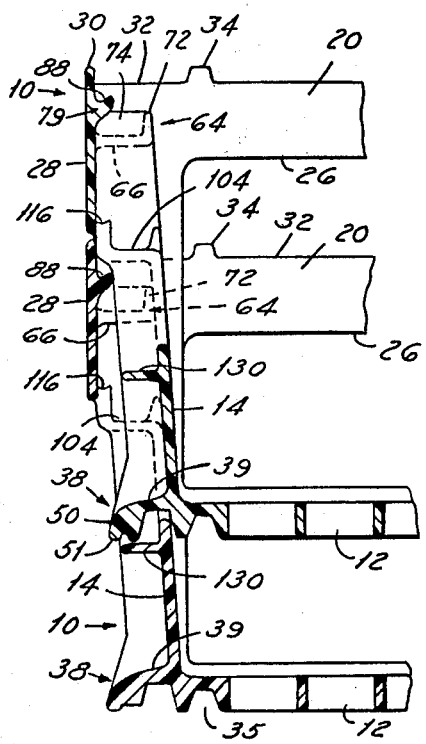
FIG. 13 is a fragmentary sectional view taken on the line 13—13 in FIG. 5.
Figure 14:
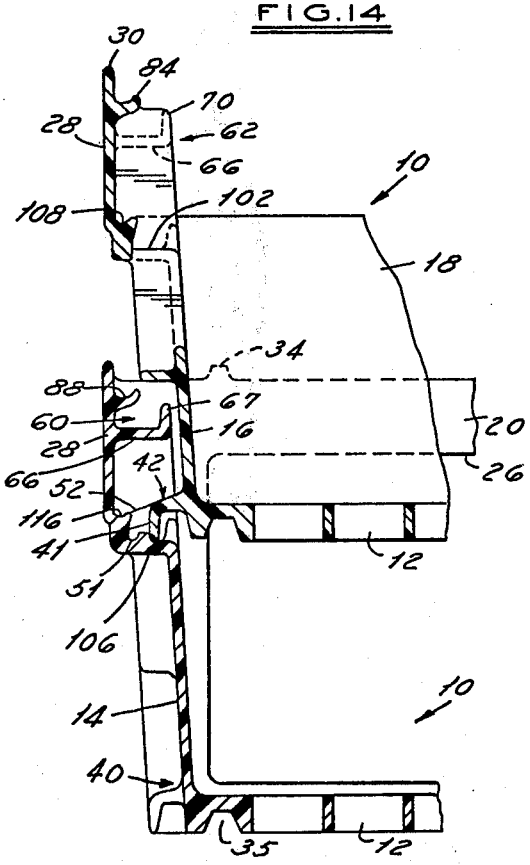
FIG. 14 is a fragmentary sectional view taken on the line 14—14 in FIG. 6.
Figure 15:
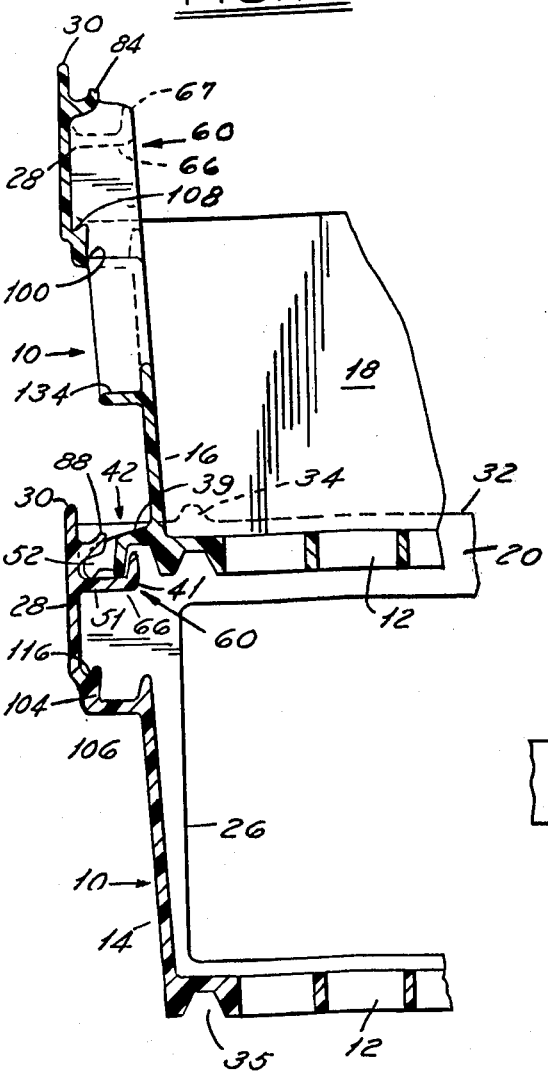
FIG. 15 is a fragmentary sectional view taken on the line 15—15 in FIG. 7.
Figure 16:
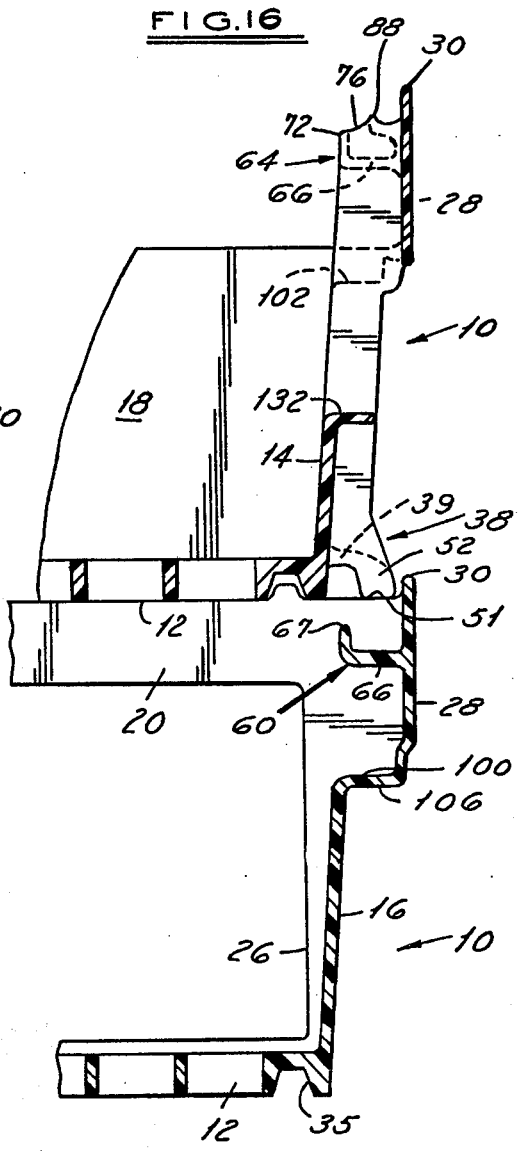
FIG. 16 is sectional view taken on the line 16—16 in FIG. 2.
Figure 17:
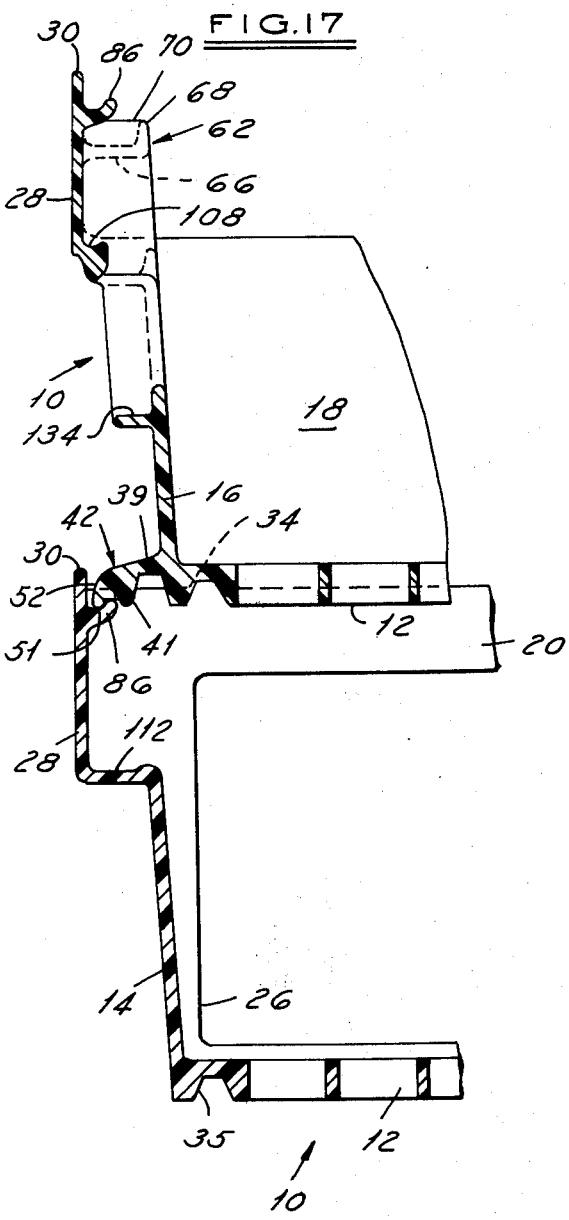
FIG. 17 is a fragmentary sectional view taken on the line 17—17 in FIG. 2.

Referring now more particularly to the drawings and especially to FIGS. 1–17, the container is open-topped and is generally designated 10. It comprises a horizontal rectangular bottom wall 12, side walls 14 and 16 and front and rear walls 18 and 20. The front and rear walls are shown as being somewhat longer than the side walls. They could be of the same length or shorter than the side walls. In the claims, the front and rear walls are referred to as "end" walls. The side walls 14 and 16 project upwardly from oppsite side edges of the bottom wall in slightly diverging relation to one another and the front and rear walls 18 and 20 project upwardly from the front and rear edges of the bottom wall in slightly diverging relation to one another. The front and rear walls and side walls are of course connected to one another at the corners of the container to confine the contents. Preferably the upper edge of the front wall is cut down as best shown in FIG. 12 to provide a central recess 22. Preferably also the rear wall has its upper edge cut down to provide the central recess 24 and is formed with the enlarged apertures 26. The recesses 22 and 24 and the apertures 26 are provided to permit access to the contents of a stack of containers.

The container may be formed of any suitable material such as plastic. Preferably it is a one-piece molding of a suitable plastic such as polypropylene or polyethylene. The flaring or outward divergence of the front, rear and side walls permits an upper container to fit down into a lower container for stacking at any one of the three different levels.

The side walls have vertically disposed horizontally extending border strips 28 defining the upper edge portions thereof. These border strips are offset slightly in an outward direction from the diverging side walls as clearly seen in the drawings. The upper edges 30 of these border strips are horizontal and disposed slightly above the level of the horizontal portions 32 of the upper edge of the rear wall 20, at approximately the level of the tips of the guiding projections 34 on the upper edge portions 32. These guiding projections 34 are adapted to engage in parallel grooves 35 in the bottom wall of an upper container as it is slid to a stacked position at the upper level as will be more fully described hereinafter. The portions 36 of the upper edge of the front wall are horizontal but cut down below the upper edges of the side wall border strips for a purpose which will become more apparent as the description proceeds.

Each side wall is a mirror image of the other, when both are viewed from the inside or from the outside of the container. Accordingly, a description of one side wall will be sufficient for both.

Each side wall has a plurality of feet 38,40 and 42 integrally molded thereto along its lower edge. Neither the number nor the particular spacing of the feet is critical although at least two and preferably three should be employed. In the present instance each foot has a horizontal flange 39 projecting outwardly from the side wall a slight distance up from the bottom which terminates at its outer edge in a downturned flange 41 that extends parallel to the side of the container and projects down to about the level of the bottom of the container. Each foot thus is channel shaped. The channel of the front foot 38 is open at the rear but is closed at the front by a web 44. The channel of the middle foot 40 is open at the front but is closed at the rear by a web 46, and the channel of the rear foot 42, while open at both ends, is bridged intermediate its ends by a web 48. The front and rear feet 38 and 42 have integrally molded slide-on guides 50 and 52. The slide-on guide 50 projects outwardly from the downturned flange 41 of foot 38, and the slide-on guide 52 projects outwardly from the downturned flange 41 of foot 42. These slide-on guides have downwardly extending ribs 51 which extend parallel to the container sides and cooperate with other guiding structure yet to be described to enable the container to slide onto an identical reversely oriented lower container for stacking either at the upper or the intermediate level.

The border strip portion 28 of each side wall is provided along its inner surface with saddles 60, 62, 64. These are the top level of saddles. The saddles on one side of the container are spaced from those on the other side the same distance as the feet. The saddles on each side are spaced from each other distances corresponding to the spacing of the feet so as to support the feet of an identical reversely oriented upper container at the top stacking level. Each saddle 60, 62, 64 has a horizontal flange 66 projecting inwardly from the border strip. The flanges 66 on both side walls are all in the same horizontal plane, and the bottom edges of the downturned flanges 41 of the feet are adapted to rest thereon in a stacked relationship of containers. The horizontal flange 66 of saddle 60 terminates at its inner extremity in an upward flange 67 which is disposed in a plane in continuation of the flared side wall. The channel formed by the border strip 28 and the flanges 66 and 67 of the saddle 60 is closed at the rear by the back wall of the container. The front of the saddle is open. The horizontal flange 66 of saddle 62 terminates at its inner edge in an upturned flange 68 which is a continuation of the flared side wall of the container. The channel formed by the border strip 28 and flanges 66 and 68 of this saddle is closed at the rear by a web 70 but is open at the front. The horizontal flange 66 of saddle 64 terminates at its inner extremity in an upturned flange 72 which is a continuation of the flared side wall of the container. The channel formed by the border strip 28 and flanges 66 and 72 of the saddle 64 is closed at the front and rear by webs 74 and 76. The upturned flange 72 is notched at 78.

When an upper container is stacked on an identical lower container on the top level of saddles 60, 62 and 64, the front feet 38 are supported by the rear saddles 60, the middle feet 40 are supported by the intermediate saddles 62 and the rear feet 42 are supported by the front saddles 64. Actually, the lower edges of the downturned flanges 41 of the feet rest upon the horizontal flanges 66 of the saddles in the stacked relationship. The upturned flanges 67, 68 and 72 of the saddles cooperate with the downturned flanges 41 of the feet to prevent the side walls of the lower container from spreading, thus maintaining a solid stacked relation even under considerable load.

The upturned flanges 67 of the rear saddles 60 are notched where indicated at 80, and the webs 44 of the front feet engage in those notches when two containers are stacked. The webs 46 of the middle feet 40 extend across the ends of the upturned flanges 68 of the middle saddles 62, and the webs 70 of the middle saddles 62 extend across the ends of the downturned flanges 41 of the middle feet when two containers are stacked. The webs 74 and 76 of the front saddles extend across the ends of the downturned flanges 41 of the rear feet 42 when two containers are stacked. The transverse webs 48 of the rear feet extend into the notches 78 of the upturned flanges 72 of the front saddles. These webs retain the feet against movement in a front to rear direction when two containers are stacked.

Slide-on guide means are provided on each container side wall at approximately the level of the saddles 60, 62 and 64 or slightly above to permit an upper container when turned end for end with respect to an identical lower container to be slid over the top of the lower container into a stacked relation at the upper level. Such slide-on guide means comprises a horizontal rib or track 79 on the inner surface of each side wall border strip 28 which is disposed outwardly of the saddles and extends for almost the full length thereof. Each rib 79 is interrupted at points along its length providing rib sections 84, 86 and 88. The rear guide rib sections 84 extend from the front edge of the rear saddles 60 of the container to a point intermediate the rear and middle saddles 60 and 62. The middle guide rib sections 86 extend from the rear of the middle saddles 62 to the rear of the front saddles 64, and the front guide rib sections 88 extend from a point intermediate the ends of the front saddles 64 to substantially the forward edge of the side wall border strips. These guide rib sections have aligned open ended upwardly facing grooves. The guide rib sections on one side wall are spaced from those on the other side wall a distance such that the downwardly extending guiding ribs 51 of the front and rear feet 38 and 42 will slidably engage the grooves of the guide rib sections to enable an upper reversely oriented container to be slid over the top of a lower container into a stacked position. When two containers are thus stacked at the upper level the slide-on guides 50 of the feet 38 fit in the clearances 90 between the rear wall of the container and the ends of guide rib sections 84, and the slide-on guides 52 of feet 42 fit into clearances 92 between the adjacent ends of guide rib sections 86 and 88. The clearances 94 between the ends of guide rib sections 84 and 86 are provided to permit stacking at the intermediate level as will become more apparent hereinafter.

Each side wall is provided with saddles 100, 102 and 104 which are the intermediate level of saddles. Saddles 100, 102 and 104 are located directly beneath the upper level saddles 60, 62 and 64 and are therefore spaced apart distances corresponding to the spacing of the feet so as to support the feet of an identical reversely oriented upper container at the intermediate stacking level. Each saddle 100, 102 and 104 has a horizontal flange 106 which projects outwardly from the side wall and which is integrally connected to the lower edge portion of the border strip 28. The flanges 106 on both side walls are all in the same horizontal plane. The flange 106 of the rear saddle 100 is connected to the border strip 28 by a horizontal guide rib or track section 108 which has a longitudinally grooved top surface at a level slightly above the horizontal flange 106 and leading rearwardly thereto. The intermediate saddle 102 has an upturned flange 110 which is an extension of the side wall of the container, and which extends over approximately the rear half portion of the intermediate saddle. A horizontal guide rib or track section 112 has a longitudinally grooved top surface at the same level as and aligned with the top surface of guide rib section 108 which is provided forwardly of the intermediate saddle and leads rearwardly thereto. The front saddle 104 has an upturned flange 114 which is an extension of the container side wall and which extends over approximately the rear half portion of the horizontal flange 106 of the front saddle. This front saddle is connected to the border strip 28 by a horizontal guide rib or track section 116 having a longitudinally grooved top surface at the same level as and aligned with the grooves of the guide rib sections 108 and 112 which leads rearwardly to the horizontal flange 106 of the front saddle. The guide rib sections 108, 112, 116 on each side wall are spaced from those on the other side wall a distance such that the guide ribs 51 on the front and rear feet of an upper container will engage the same when slid to a stacked position at the intermediate level.

When two containers are stacked at the intermediate level, the downturned flanges 41 of the front feet 38 of the upper container rest upon the horizontal flanges 106 of the rear saddles 100. The side walls are apertured at 118 to accommodate the slide-on guides 50 of the feet 38. The downturned flanges 41 of intermediate feet 40 rest upon the horizontal flanges 106 of the intermediate saddles 102, and the downturned flanges 41 of rear feet 42 rest upon the horizontal flanges 106 of the front saddles 104. The side walls are apertured at 120 to clear the slide-on guides 52 of the feet 42. The upturned flanges 110 and 114 cooperate with the downturned flanges 41 of the feet 40 and 42 to prevent spreading of the side walls under load. The upper container stacked at the intermediate level is restrained from forward or rearward movement by the transverse abutment surfaces of the lower container designated 122, 124, 126 and 128 which engage the feet of the upper container.

Each side wall is provided with saddles 130, 132 and 134 which are the lower level of saddles. Saddles 130, 132 and 134 are spaced apart distances corresponding to the spacing of the feet so as to support the feet of a similarly oriented upper container at the lower stacking level. The upper edge portion of each diverging side wall 14, 16 is cut down to provide apertures 136, 138 and 140. Projecting outwardly from the lower horizontal edge of these apertures are horizontal flanges which define the saddles. The front saddle 130 has an upturned flange 144 which actually is an extension of the diverging side wall of the container. This flange terminates short of the front wall of the container to provide a space or notch 146. The rear saddle has an upturned flange 148 along its full length which is an extension of the diverging side wall of the container. This flange 148 is notched intermediate its ends where indicated at 150.

Figures 1, 2:
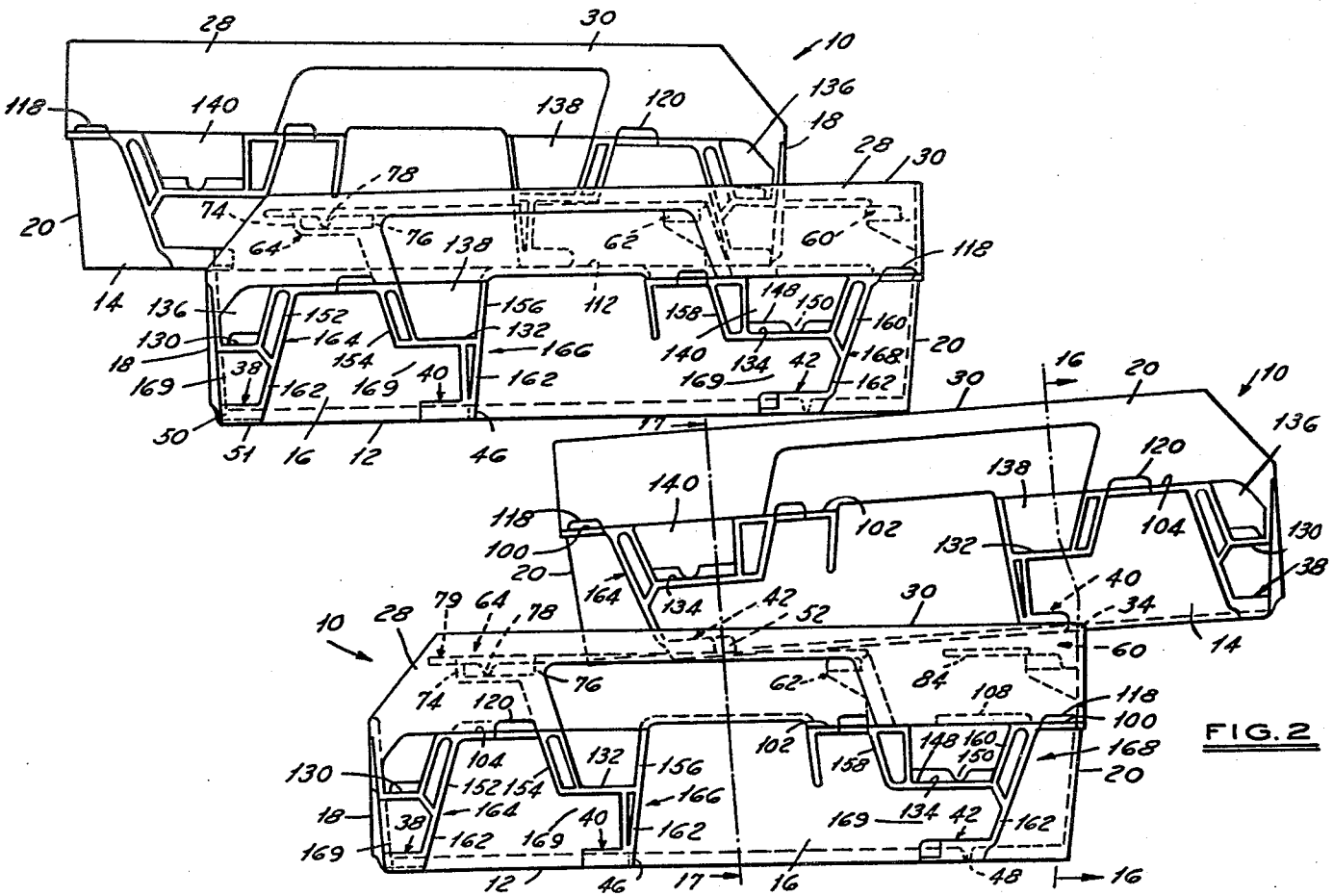
FIG. 1 is a side elevational view showing two containers of our invention, the upper container being reversed end for end with respect to the lower container and being slid over the lower container to a stacked position at the intermediate level. The containers are identical.
FIG. 2 is similar to FIG. 1 but shows the upper container being slid from the opposite direction over the lower container to a stacked position at the uppermost level.
Figure 3:
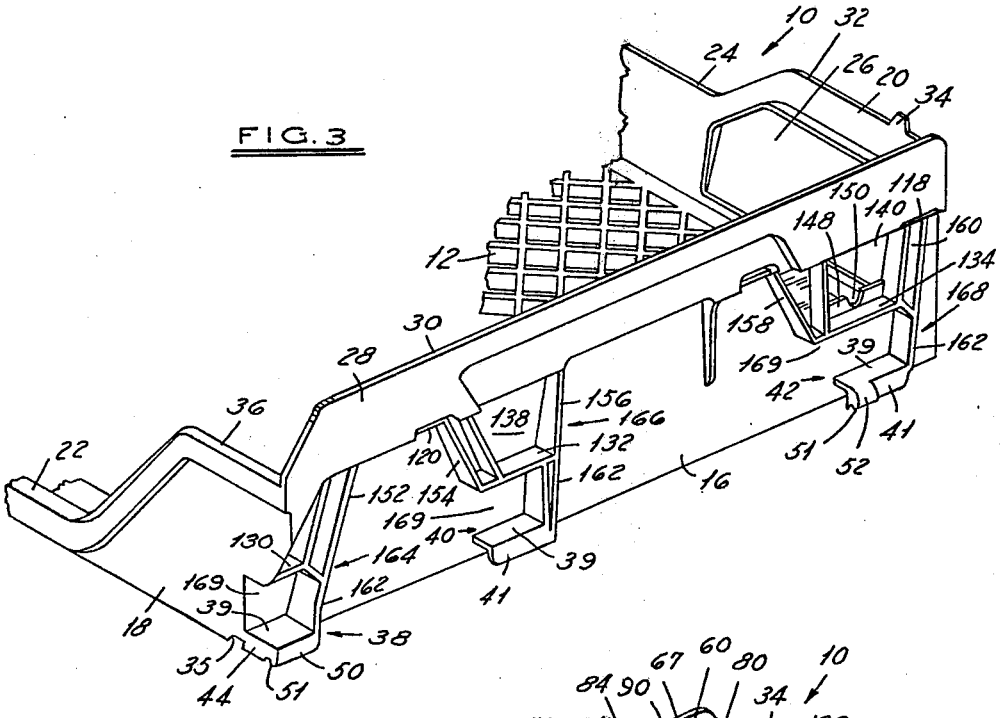
FIG. 3 is a fragmentary perspective view showing one side of the container as seen from the outside.
Figure 4:
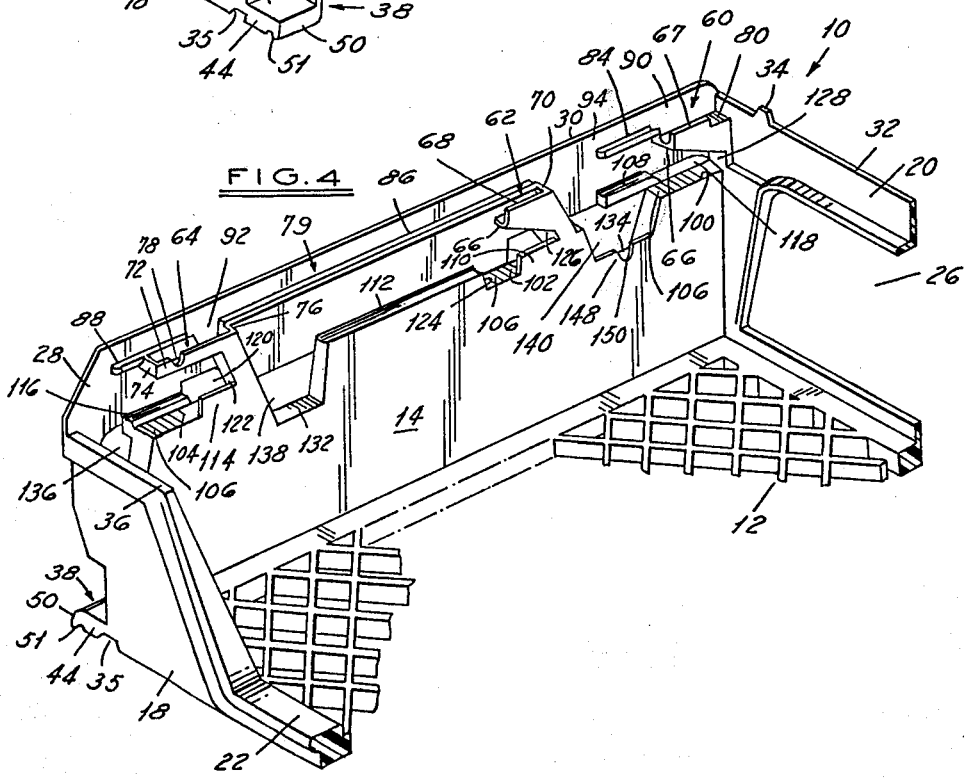
FIG. 4 is a perspective view of the other side of the container as seen from the inside.
Figure 5:
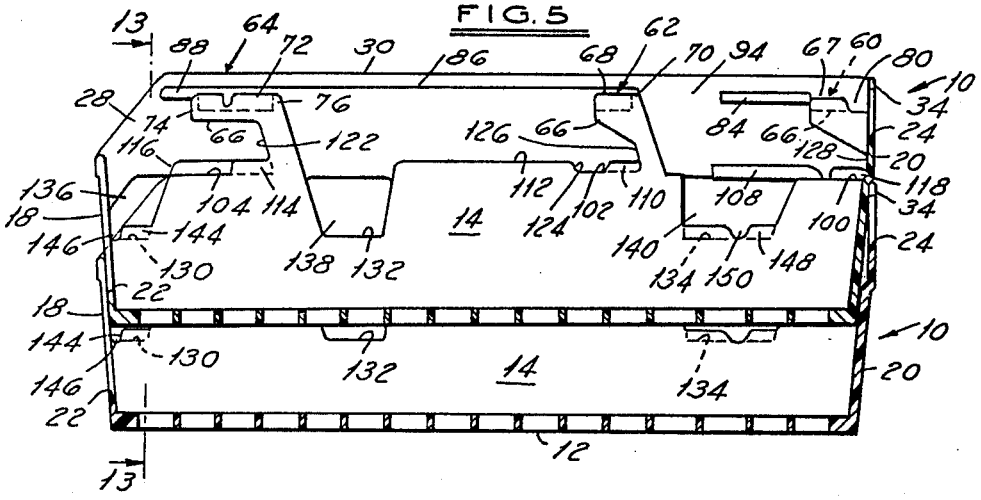
FIG. 5 is a sectional view showing two containers stacked at the lowermost level.
Figure 6:
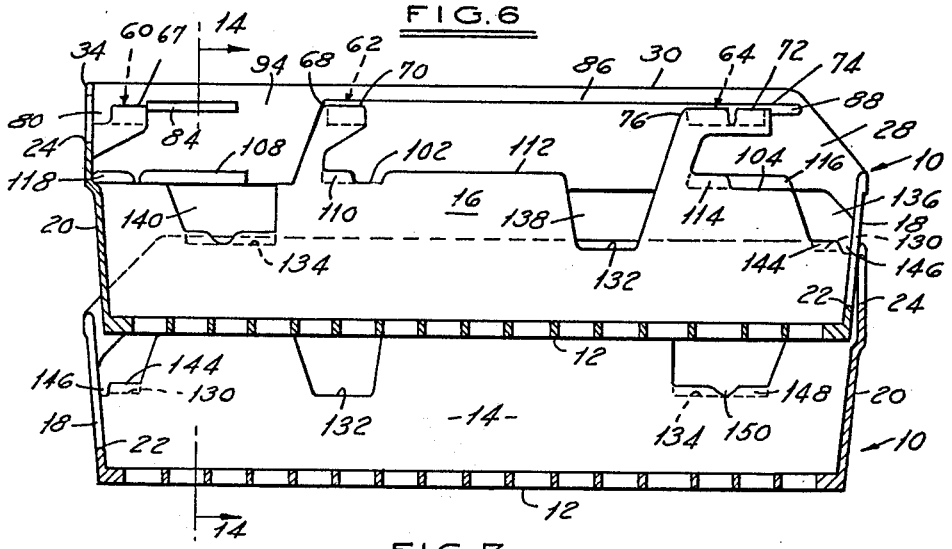
FIG. 6 is a sectional view showing two containers stacked at the intermediate level.
Figure 7:
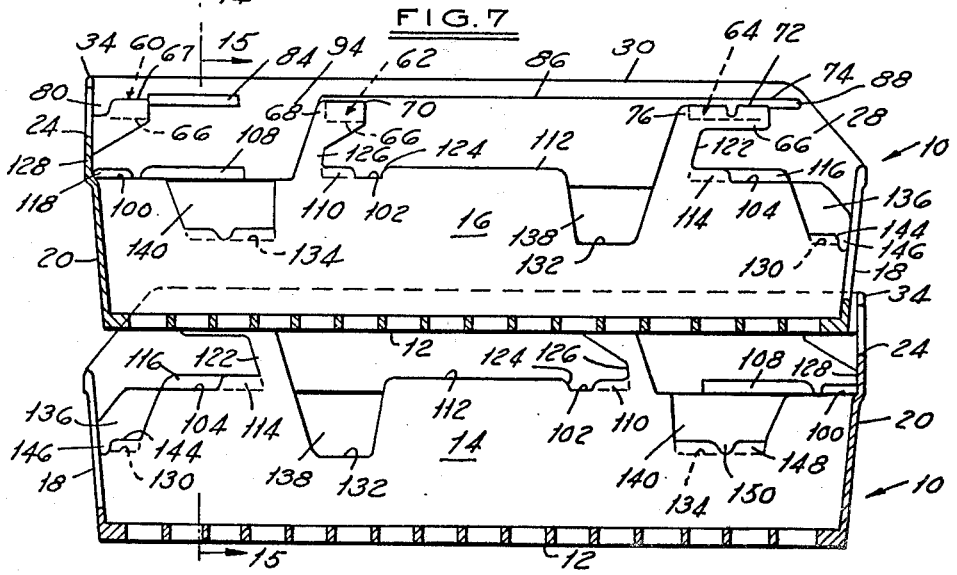
FIG. 7 is a sectional view showing the containers stacked at the uppermost level.
Figure 8:
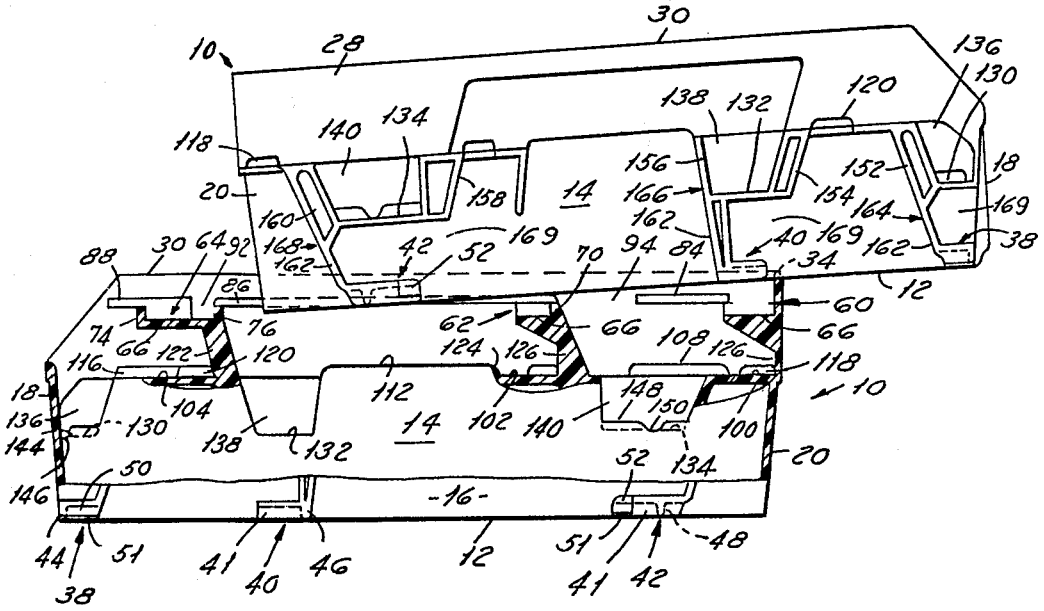
FIG. 8 is a view similar to FIG. 2 but shows the lower container partly broken away and in section.

Ribs 152-162 projecting outwardly from the container side walls are connected to the lower ends of the saddle flanges and extend down to the feet. These ribs cooperate with the saddle flanges and the feet to define downwardly tapering fluted elements 164, 166 and 168 on the outer sides of the container as best seen in FIGS. 1, 2 and 3 of the drawings. The ribbing defining these fluted elements is open where indicated at 169 on one side to clear the upper saddles when a container is stacked on the intermediate level of saddles.

When two identical containers are stacked at the lowermost level, the downturned flanges 41 of the front feet 38 of the upper container rest upon the horizontal saddles 130 at the front of the container. The web 44 of foot 38 extends into the notch 146. The downturned flanges 41 of intermediate feet 40 rest upon the intermediate saddles 132. The downturned flanges 41 of the rear feet 42 rest upon the horizontal saddles 134. The webs 48 of the feet 42 extend into the notches 150. The upturned flanges 144 and 148 cooperate with the downturned flanges 41 of feet 38 and 42 to prevent spreading of the side walls under load. The upper container stacked at the lowermost level is restrained from forward or rearward movement by the ribs 152, 162 which engage the feet of the upper container.

It will be noted that when an upper container is stacked at the lowermost level its fluted elements 164, 166 and 168 on the outer side walls project down into the apertures 136, 138 and 140. Such apertures are downwardly tapered approximately the same as the downwardly tapering fluted elements to fully receive them for stacking.

When stacked at the lowermost level, occasionally one or more of the feet will not come down into contact with the saddles 130, 132 and 134 intended for their support. This can occur if the diverging side walls of the two containers come into wedging contact with one another when the upper container is lowered to a stacked position at the bottom level. It is also possible by increasing the vertical dimension of the border strips 28 to cause stacking at the lower level to occur by engagement of the border strips of the two containers rather than by a direct engagement of one or more of the feet with the appropriate saddles. Preferably the feet will rest upon the saddles 130, 132 and 134 when stacking is at the lower level.

When it is desired to stack two containers at the top level the upper container is reversed end for end with respect to an identical lower container, and the slide-on guides 52 of the rear feet 42 are engaged in the grooves of the rear guide rib sections 84 as shown in FIG. 2. The upper container is then slid horizontally to an aligned position over the lower container. The slide-on guides 52 are carried over the spaces 94 between the rear and middle guide rib sections 84 and 86 by engagement of the webs 48 of the feet with web 70 of the middle saddle 62. The upper container guided by the middle guide rib sections continues to move over the lower container, with the grooves 35 in the bottom of the upper container guided by the projections 34 on the rear wall of the container. When the upper container reaches a position of substantially exact vertical alignment over the lower container, the slide-on guides 50 and 52 drop into the spaces 90 and 92 so that the downturned flanges 41 of the feet 38, 40 and 42 will come to rest upon the horizontal flanges 66 of the saddles 60, 62, and 64 to firmly support the upper container stacked at the top level.

Figure 9:
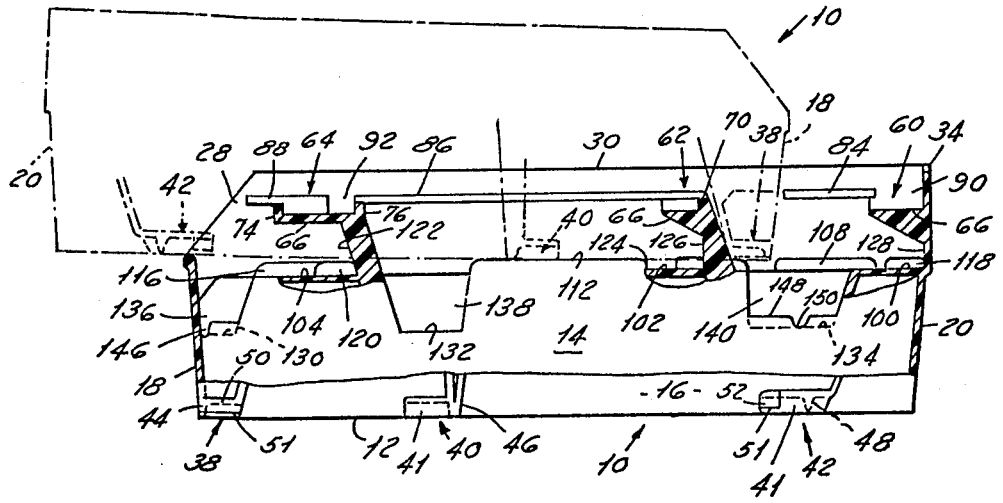
FIG. 9 is similar to FIG. 1 but shows the upper container in phantom lines and the lower container partly broken away and in section.
Figure 10:
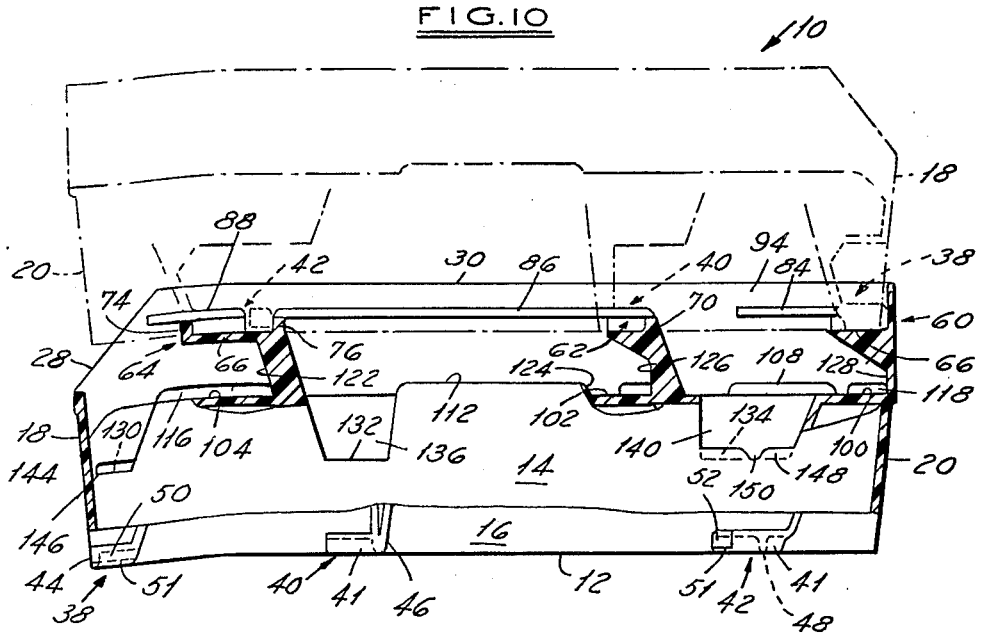
FIG. 10 is similar to FIG. 7 but shows the upper container in phantom lines and the lower container partly broken away and in section.
Figure 11:
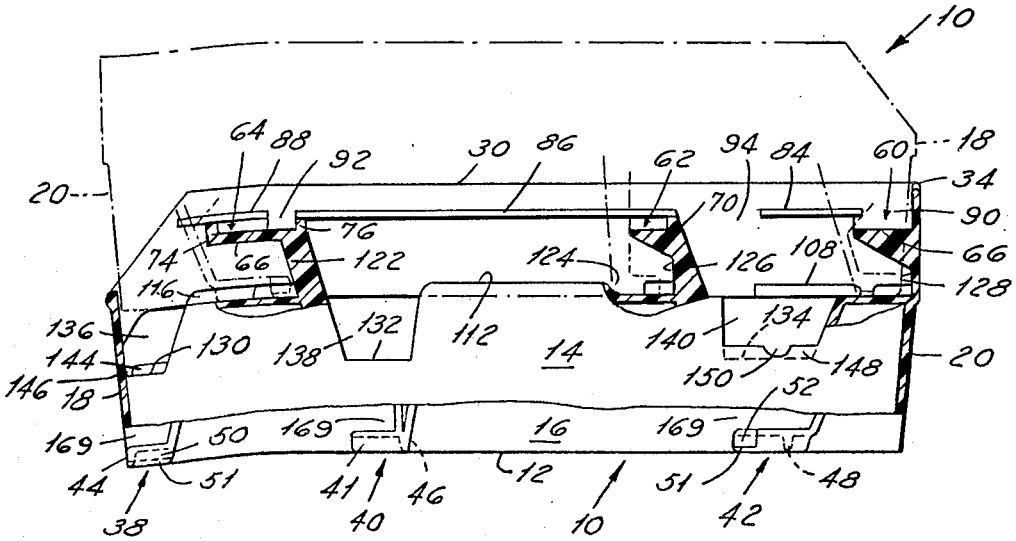
FIG. 11 is similar to FIG. 6 but shows the upper container in phantom lines and the lower container partly broken away and in section.

When it is desired to stack two identical containers at the middle level, the upper container is reversed end for end with respect to the lower container but the upper container is slid on in a direction opposite to that for stacking at the top level. With reference to FIGS. 1 and 9, the slide-on guides 51 of the front feet 38 of the upper container are engaged in the grooves of the front guide rib sections 88. The slide-on guides 51 bridge the spaces 92 between the front and middle guide rib sections 86 and 88. The upper container is guided by the middle guide rib sections 86 until the point is reached where the guides 51 of the front feet fall into the spaces 94 between the rear and middle guide rib sections 84 and 86. The upper container then drops to the intermediate level where the downturned flanges 41 of the middle feet 40 engage and are guided by the middle guide rib sections 112 at the intermediate level. Note the greater width of the middle guide rib sections 112 so that they can support either the guides 51 of the front feet or the middle feet. During the continued movement of the top container to stacked position, the bottom slides upon the portions 36 of the top edge of the front wall 18 of the lower container. As the container continues to slide, the slide-on guides 50 and 52 of the front and rear feet also come into engagement with the guide rib sections 108 and 116 at the intermediate level. Finally, when the upper container is substantially vertically aligned over the lower container it drops into seated position in which the downturned flanges 41 of its feet rest upon the horizontal flanges or saddles 100, 102 and 104. The apertures 118 and 120 in the side walls of the container clear the slide-on guides 50 and 52 of the front and rear feet. The open spaces 169 in the fluted elements 164, 166 and 168 clear the upper saddles when stacking is at the intermediate level.

When it is desired to stack two identical containers at the lowermost level, the upper container is similarly oriented with respect to the lower container. It is poised over the lower container in substantially vertically aligned position and then is lowered directly into seating engagement of the flanges 41 of its feet with the lowermost saddles 130, 132 and 134.

Figure 20:
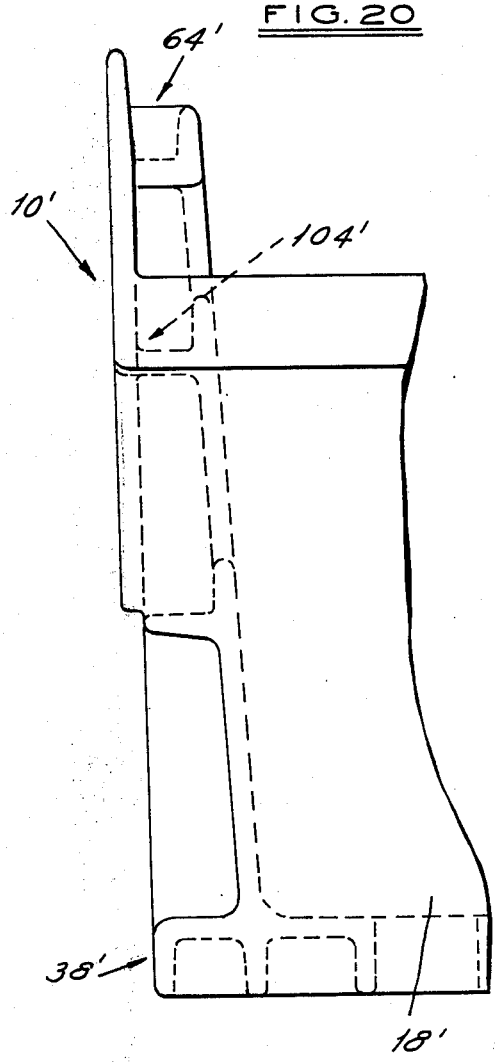
FIG. 20 is a fragmentary elevational view as seen on the line 20—20 in FIG. 19 of a portion of the modified container.
Figure 18:
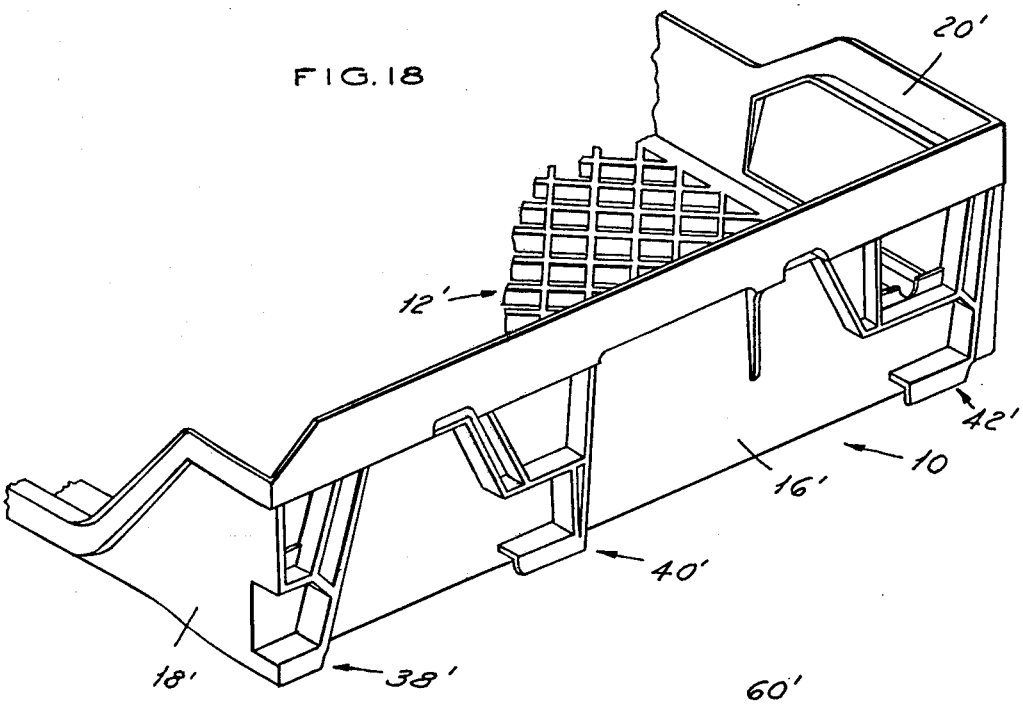
FIG. 18 is a fragmentary perspective view showing one side of a container of modified construction as seen from the outer side.
Figure 19:
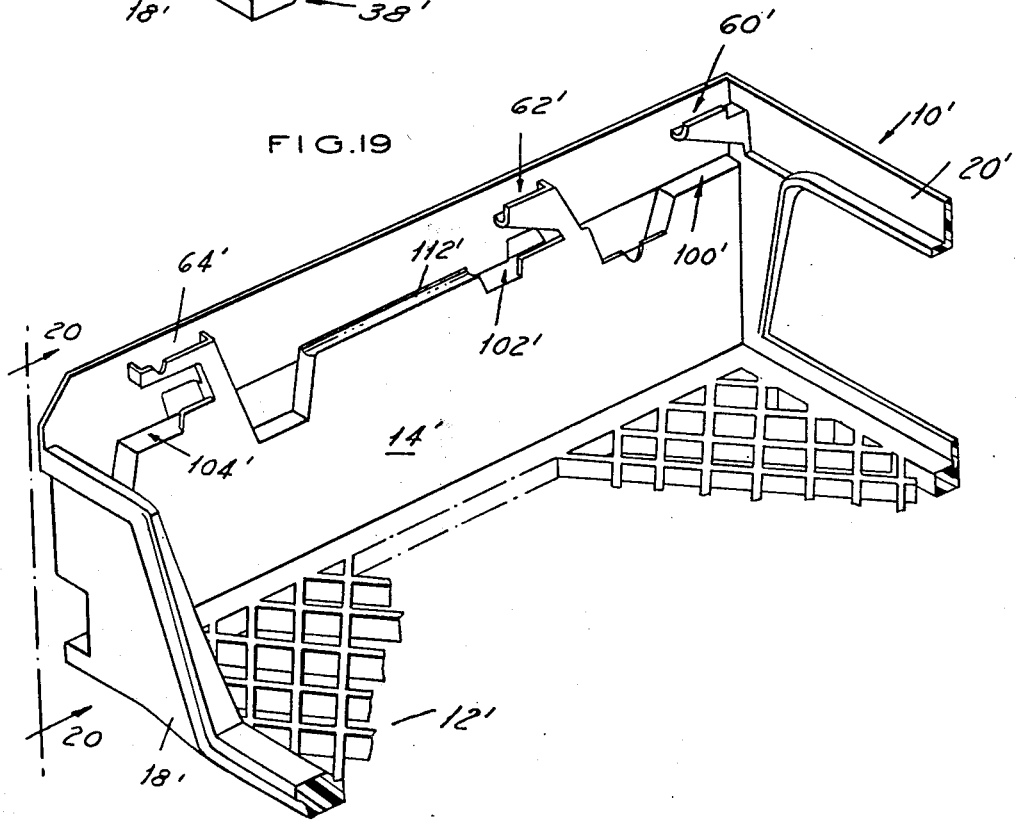
FIG. 19 is a fragmentary perspective view of the other side of the modified container as viewed from the inner side.

FIGS. 18-20 illustrate a modification of the container. The modified container designated 10', is virtually the same as the one first described except for the omission of the slide-on feature. In other words, the feet 38' 40' and 42' are like the feet 38, 40 and 42 of the first embodiment but do not have the slide-on guides 50 and 52. In addition, the top level guiding ribs 79, which form part of the first described container, are omitted. Also, omitted are the horizontal guide rib sections 108 and 116 at the intermediate level. The intermediate level guide rib sections 112 of the first described container are retained in the container of FIGS. 18–20 and are identified as 112'. The other parts of the container illustrated in FIGS. 18–20 are like the corresponding parts of the first described container and are identified by corresponding reference numerals primed.

In order to stack the container of FIGS. 18–20 upon another identical container at the top stacking level, it is reversed end for end with respect to the lower container, placed directly above the lower container and then lowered so that its feet 38', 40' and 42' engage and rest upon the saddles 60', 62' and 64' in the same relationship as described and illustrated with respect to the first embodiment.

In order to stack the container of FIGS. 18–20 upon an identical lower container at the intermediate level, it is reversed end for end with respect to the lower container and placed over the lower container in approximately the same relationship as shown in FIG. 1, that is with its rear end overhanging and if desired resting on the upper edges of the front wall of the lower container and with its middle feet 40' resting upon the guide rib sections 112'. The upper container is then slid in a direction which would be to the right in FIG. 1 to a point where the feet of the upper container overlie and rest upon the intermediate level of saddles 100' 102' and 104' in the same relationship as described and shown in connection with the embodiment of FIGS. 1–17.

In order to stack the containers of FIGS. 18–20 upon an identical lower container at the lower level, it is oriented similarly with respect to the lower container, is poised over the lower container in substantially vertically aligned position and then is lowered directly into seating engagement of its feet 38', 40' and 42' with the lowermost level of saddles 130', 132' and 134' in the same relationship as shown and described in connection with the first embodiment.

What we claim as our invention is:

1. A stacking container comprising a generally rectangular bottom wall, first and second side walls extending upwardly in diverging relation from opposite sides of said bottom wall, stacking means for supporting said container in stacking relation upon a lower container of identical construction at at least two different levels, said stacking means comprises spaced feet on each side wall, said stacking means also comprising a first set of spaced saddles on each side wall and a second set of spaced saddles on each side wall at a different level than the first set of saddles, the spacing of the saddles of the first set on said first and second side walls corresponding respectively to the spacing of the feet on said second and first side walls, the spacing of the saddles of the second set on said first and second side walls corresponding respectively to the spacing of the feet on the second and first side walls, whereby said feet are adapted to rest upon the saddles of said first set or upon the saddles of said second set of a lower container of identical construction when turned end for end with respect thereto to support said container in stacked relation thereon at either of two different levels.

2. The container defined in claim 1, wherein said side walls have guide means associated with the saddles of the first set and guide means associated with the saddles of the second set, said guide means being adapted to be engaged by cooperating means on certain of the feet of an identical upper container to enable the latter to be slid over said container to a stacked position on the saddles at either of the two different levels.

3. The container defined in claim 1, wherein the saddles of one set are respectively vertically directly above those of the other set.

4. A stacking container comprising a generally rectangular bottom wall, first and second side walls extending upwardly in diverging relation from opposite sides of said bottom wall, stacking means for supporting said container in stacking relation upon a lower container of identical construction at at least two different levels, said stacking means comprising spaced feet on each side wall, said stacking means also comprising a first set of spaced saddles on each side wall and a second set of spaced saddles on each side wall at a level below the first set of saddles, the spacing of the saddles of the first set on said first and second side walls corresponding respectively to the spacing of the feet on said second and first side walls, the spacing of the saddles of the second set on said first and second side walls corresponding respectively to the spacing of the feet on the first and second side walls, whereby said feet are adapted to rest upon the saddles of said first set of a lower container of identical construction when turned end for end with respect thereto to support said container in stacked relation thereon at a higher level and are also adapted to rest upon the saddles of said second set of a lower container of identical construction when similarly oriented with respect thereto to support said container in stacked relation thereon at a lower level.

5. The container defined in claim 4 wherein said side walls have guide means associated with the saddles of the first set adapted to be engaged by cooperating means on certain of the feet of a reversed, identical upper container to enable the latter to be slid over said container to a stacked position on the saddles of the first set.

6. The container defined in claim 4, wherein said stacking means also comprises a third set of spaced saddles on each side wall at a level above the first and second sets of saddles, the spacing of the saddles of the third set on said first and second side walls corresponding respectively to the spacing of the feet on said second and first side walls, whereby said feet are adapted to rest upon the saddles of said third set of a lower container of identical construction when turned end for end with respect thereto to support said container in stacked relation thereon at a level above the first and second sets of saddles.

7. The container defined in claim 6, wherein said side walls have guide means associated with the saddles of the first set and guide means associated with the saddles of the third set, said guide means being adapted to be engaged by cooperating means on certain of the feet of a reversed, identical upper container to enable the latter to be slid over said container to a stacked position on the saddles of the first or the third set.

8. The container defined in claim 7, wherein said guide means are in the form of generally horizontal tracks.

9. The container defined in claim 8, wherein the tracks associated with the saddles of the third set are interrupted to clear certain feet of a reversed, identical upper container during movement thereof to a stacked position on the saddles of the first set.

10. The container defined in claim 7, wherein said container has an end wall extending upwardly from one end of said bottom wall, and additional cooperating guide means on the bottom wall and on said end wall, so that during sliding movement of a reversed, identical upper container to stacked position on the saddles of said third set, said additional guide means on the bottom wall of the upper container will engage said additional guide means on said end wall of the lower container.

11. The container defined in claim 10, wherein said additional guide means comprises grooves in said bottom wall and projections on said one end wall.

12. The container defined in claim 4, wherein the side walls of said container directly above the saddles of the second set are relieved to clear the feet of a similarly oriented upper container of identical construction, permitting stacking thereof upon the saddles of the second set by a direct vertical lowering movement.

13. The container defined in claim 6, wherein the feet of said container, when stacked upon the saddles of an identical lower container, have means engageable with the saddles upon which they are stacked for restraining lateral movement of said feet under load.

14. The container defined in claim 1, wherein said side walls have guide means associated with the saddles of the upper set adapted to be engaged by cooperating means on certain feet of an identical upper container to enable the latter to be slid over said container to a stacked position on the saddles of said upper set, said guide means being interrupted to clear certain feet of an upper container during movement thereof to a stacked position on the saddles of the lower set.

15. The container defined in claim 4, wherein the saddles of said first set are offset with respect to the saddles of said second set.

16. A stacking container comprising a generally rectangular bottom wall, first and second side walls extending upwardly in diverging relation from opposite sides of said bottom wall, stacking means for supporting said container in stacking relation upon a lower container of identical construction at at least two different levels, said stacking means comprising spaced feet on each side wall, said stacking means also comprising a first set of spaced saddles on each side wall and a second set of spaced saddles on each side wall at a different level than the first set of saddles, the spacing of the saddles of the first set on said first and second side walls corresponding respectively to the spacing of the feet on said second and first side walls, the spacing of the saddles of the second set on said first and second side walls corresponding respectively to the spacing of the feet on the first and second side walls, whereby said feet are adapted to rest upon the saddles of said first set of a lower container of identical construction when turned end for end with respect thereto to support said container in stacked relation thereon at one level and are also adapted to rest upon the saddles of said second set of a lower container of identical construction when similarly oriented with respect thereto to support said container in stacked relation thereon at another level.

17. The container defined in claim 16, wherein said side walls have guide means associated with the saddles of the higher of the two sets of saddles adapted to be engaged by cooperating means on certain of the feet of an identical upper container to enable the latter to be slid over said container to a stacked position on the saddles of the said higher set.

18. The container defined in claim 16, wherein the saddles of said first set are offset with respect to the saddles of said second set.

19. The container defined in claim 16, wherein said side walls have guide means associated with the saddles of the higher of the two sets of saddles adapted to be engaged by cooperating means on certain of the feet of an identical upper container to enable the latter to be slid over said container to a stacked position on the saddles of said higher set, said guide means being interrupted to clear certain feet of an identical upper container during movement thereof to a stacked position on the saddles of the lower of the two sets of saddles.

20. A stacking container comprising a generally rectangular bottom wall, side walls extending upwardly in diverging relation from opposite sides of said bottom wall, stacking means for supporting said container in stacked relation upon a lower container of identical construction at at least two different levels, said stacking means comprising feet on said side walls, said stacking means also comprising an upper set of saddles on said side walls and a lower set of saddles on said side walls at a lower level than the upper set of saddles, said feet being adapted to rest upon the saddles of said upper set or upon the saddles of said lower set of a lower container of identical construction to support said container in stacked relation thereon at either of two different levels, said side walls have guide means associated with the saddles of said upper set adapted to be engaged by cooperating means on certain of the feet of an identical upper container to enable the latter to be slid in one direction over said container to a stacked position on the saddles of said upper set, said guide means having gaps to clear certain feet of an upper container during movement thereof in the opposite direction to a stacked position on the saddles of said lower set, said container having means bridging said gaps when said container is slid in said one direction to a stacked position on the upper set of saddles of a lower container to carry said container across said gaps.

* * * * *